United States Patent [19]

Vanoni et al.

[11] 4,234,652

[45] Nov. 18, 1980

[54] MICROFIBROUS STRUCTURES

[75] Inventors: Pier L. Vanoni, San Donato Milanese; Giancarlo Serboli, Soronno; Franco De Marchi, Milan, all of Italy

[73] Assignee: Anic, S.p.A., Palermo, Italy

[21] Appl. No.: 27,868

[22] Filed: Apr. 6, 1979

Related U.S. Application Data

[63] Continuation of Ser. No. 722,137, Sep. 10, 1976, abandoned.

[30] Foreign Application Priority Data

Sep. 12, 1975 [IT] Italy ..... 27206 A/75
Aug. 13, 1976 [IT] Italy ..... 26263 A/76

[51] Int. Cl.[3] ..... D04H 1/04

[52] U.S. Cl. ..... 428/296; 210/508; 424/78; 424/81; 424/83; 210/679; 210/698; 428/378; 428/903

[58] Field of Search ..... 210/505, 508, 36, 58, 210/504, 509; 162/163, 146, 162; 428/903, 905, 296, 289, 375, 378, 379; 424/78, 81, 83

[56] References Cited

U.S. PATENT DOCUMENTS

| | | | |
|---|---|---|---|
| 3,755,064 | 8/1973 | Maierson | 428/903 |
| 3,953,282 | 4/1976 | Tabara et al. | 162/162 |
| 3,965,283 | 6/1976 | Moore | 210/36 |
| 4,025,679 | 5/1974 | Denny | 210/508 |

OTHER PUBLICATIONS

Moncrieff R.W.; "Man-Made Fibers"; John Wiley & Sons Inc.; 6th Ed. pp. 614–619 (1974).

*Primary Examiner*—Benoit Castel
*Attorney, Agent, or Firm*—Morgan, Finnegan, Pine, Foley & Lee

[57] ABSTRACT

Microfibers of thermoplastic polymeric materials which have occluded therein materials such as pigments, dyestuffs, medicaments and other man-made or synthetic materials that can be released therefrom as desired.

3 Claims, 1 Drawing Figure

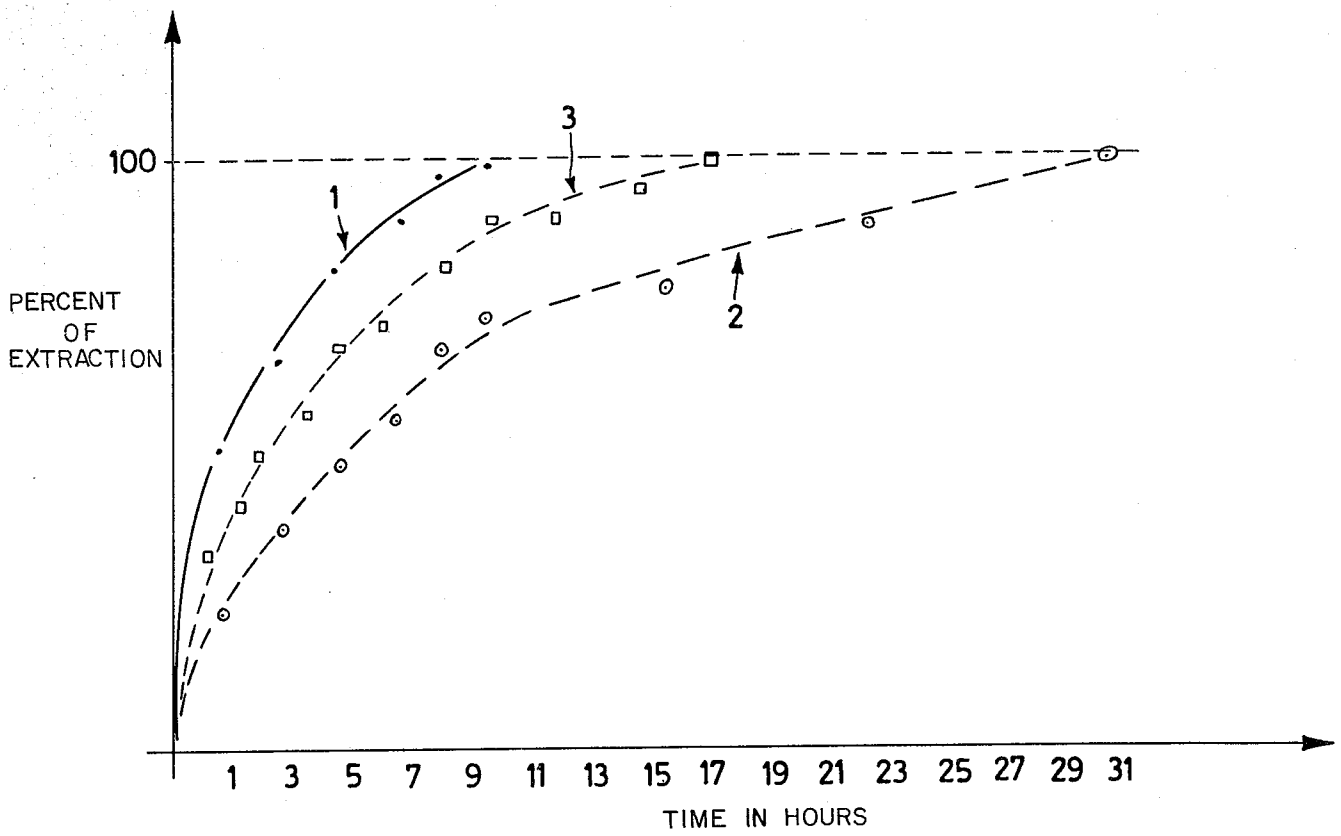
100
PERCENT OF EXTRACTION
1
2
3
1 3 5 7 9 11 13 15 17 19 21 23 25 27 29 31
TIME IN HOURS

MICROFIBROUS STRUCTURES

This is a continuation of application Ser. No. 722,137 filed Sept. 10, 1976, now abandoned.

This invention relates to microfibrous structures having substances occluded therein.

It is known to deposit substances of various natures on supporting structures; for example, in the paper industries, a number of different techniques have been adopted for the impregnation, dyeing, reinforcing or appropriately colouring the paper materials.

However, the techniques heretofore used tend to result in loss of the materials deposited during processing, the result being the pollution of the processing media.

It has now been found that these drawbacks can be overcome by occluding substances of various natures, in microfibrous structures, at such levels as to govern, or to prevent, the release within reactive media with which such structures may come into contact.

As a matter of fact, according to the present invention, different products are obtained, according to whether it is desired that no release may take place, such as in the case of dyestuffs used in the dyeing art in general, or that the release of the occluded substances may taken place gradually over a certain time interval.

According to a particular aspect of the invention, it has been found that microfibers as obtained from synthetic or man-made polymeric materials are useful for this purpose.

They permit that substances may be occluded by adsorption (as they have an extremely high specific surface area), or by coextrusion at the instant of the fiber-formation.

Microfibrous structures which can be employed are all those structure which are the result of particular treatments of polymer materials, such as for example disclosed in the Italian Patent Specification No. 963,102, the structures of which are particularly advantageous in the case of a coextrusion.

Synthetic microfibers can be manufactured starting from any kind of synthetic and man-made thermoplastic material by using appropriate solvents and fiber-forming fluids for each type of polymer. Thermoplastic materials which can be used for reducing the present invention to practice are the thermoplastic products capable of producing fibers, such as for example low-density polyethylene and copolymers of ethylene with vinyl acetate and acrylic acid, high-density polyethylene and relevant ethylene copolymers, polypropylene, polyvinyl acetate, polyvinyl alcohol, polystyrene, polyamides, polyethylene terephthalate, cellulose acetate and others.

It has thus become possible to provide colored microfibers which can be used in the paper industry in union with cellulose pulp, to obtain colored paper without having colored waste waters, pollution problems being thus put aside, it being also possible to obtain microfibers which contain chemicals, such as medicaments, antiseptics, pesticides, microorganisms and others which thus permit that these are gradually released in the appropriate medium within a controllable time, such as may be required in the case of substances for which a time-programmed release is desired, such as for example chemicals or biological substances having a therapeutical action, for which it may be desirable to have such an absorption as to originate optimum blood levels extended to a certain time.

The microfiber structures of the present invention with the occluded materials there in can be formed either by causing such structures to adsorb the material concerned, or by admixing solutions of the polymer with solutions, suspensions or powders of such material and subsequently carrying out the microfiber formation process. The microfiber structure can thus take up as much as 50% of its own weight.

The supplemented microfiber structure can be subsequently processed in the forms and according to the procedures which are the most suited for the further applications thereof.

As outlined above according to whether the one or the other procedure is used, controlled-release materials are obtained, which vary from no release to a comparatively gradual release.

It has also been found that an appropriate admixture of materials prepared according to the procedures now described, permits a controlled release with the amounts of the released substances which is a function of the particular necessities of use.

BRIEF DESCRIPTION OF THE DRAWING

The accompanying drawing is a plot of the respective release times of material occluded in synthetic microfibers through three different procedures in accordance with our invention.

As a matter of fact, as can be seen in the accompanying plot, which reports curves relative to the release of sodium benzoate, occluded according to various procedures in microfibers of polyethylene of high density, and in which the abscissae report the release times and the ordinates the percentages of extraction in time, while in the case of substances imbibed according to the second of the mentioned procedures (line 1), the release becomes total within 10 hours, in the case of the substances occluded according to the first procedure (line 2), the total release takes place not only more evenly, but also within a time interval which is longer, that is, 31 hours.

It has also been found that, for particular applications, in order to achieve a high release in the first hours after treatment, it is possible to admix with the material now described, also active or inert substances as such (the same material which had already been occluded through the preceding procedures), thus obtaining an intermediate release rating, as can still be seen in the accompanying plot (line 3). A further object of the present invention, without departing from the scope thereof, is the application of the same material to the treatments which are necessary to prevent the deposits of incrusting material on the apparatus in which said phenomena are most frequently experienced, for example to prevent the deposit of calcium carbonate in the boilers or more generally in those apparatus which use water at a temperature higher than the ambient temperature as the treatment fluid, and in which, to prevent incrustations, sequestering agents are directly added to the water stream.

In accordance with the foregoing, it is possible to occlude such substances, such as phosphonates or other sequestering agents, in the microfiber structures, the method of occlusion being a function of the particular release mode which is necessary, so as to achieve a continuous sequestering action without consuming an exceedingly high amount of the sequestering agent and thus with a considerable economical advantage.

Another object of the present invention is to apply such microfibrous structures to the recovery, and subsequent removal, of sludges which pollute the waste waters from processing operation.

As a matter of fact, it is possible to disperse such microfibrous structures in a comparatively low amount (due to their bulk) in the waste waters of industrial processes and then, through conventional methods of precipitation and flocculation, to precipitate the suspensions so as to obtain a mass of microfibrous structure and sludges which is subsequently compacted by appropriate methods, the result being blocks of polluting materials occluded in said microfibrous structures so that said materials, due to their not being further released, permit a subsequent treatment of discharge or recovery, the costly methods as used at present being thus no longer necessary.

The ensuing examples are intended to better explain the invention without however limiting it in the slightest.

EXAMPLE 1

A jacketed autoclave equipped with a stirrer is charged with n-heptane and high-density polyethylene (M.F. 3.5) so that the concentration of polyethylene is 7% relative to n-heptane, on a weight basis. A compound of high-density polyethylene which contained a red organic pigment (condensation bis-azoic red) in a concentration of 25% (the commercial product has been supplied by SARMA under the symbol MBP 5555 red 4A), has then been added in such an amount that the final concentration of the pigment in the polyethylene was 2. Heating with stirring is then carried out at 175° C. (corresponding to a pressure of 6.5 kg/sq. cm) until the solution is thoroughly homogenized. The solution is fed by a gear pump which raises the pressure from 6.5 to 35–40 kg/sq. cm, to a heat-exchanger and then caused to be ejected through a nozzle having the diameter of 1 millimeter and the thickness of 1 millimeter. The temperature of the solution prior to being expanded is about 200° C. The product which is obtained is composed by very thin red-colored microfibers, having a length ranging from 1 to 10 millimeters, with an average diameter of about 10 microns. The thus obtained microfibers can be used for the manufacture of colored paper, either alone or in admixture with cellulose pulp by employing the conventional continuous paper machinery. A concentration of 30% of microfibers has proved to be particularly suitable. During the manufacture of the paper, no dyestuff release has been experienced, the waste waters thus being absolutely clean.

EXAMPLES 2 and 3

High density polyethylene, blue and green microfibers have been prepared by using, with the same procedure as in example 1, a high-dnsity polyethylene compound containing an organic blue pigment and an organic green pigment, respectively (beta-phthalocyanine dyestuffs, commercial products supplied by SARMA under the symbols MBP 5555 blue 7A and green, 6A) in a concentration of 25% so as to have a final pigment concentration in polyethylene of 2%. The microfibers thus obtained have been used for manufacturing colored paper, in admixture with cellulose pulp, on a conventional continuous machine without having the waste waters polluted by any dyestuff.

EXAMPLE 4

Colorless microfibers of polyethylene, as produced according to the procedure of Example 1, without any addition of colored compound or any other additive, have been suspended in a 10% aqueous solution of sodium benzoate. They have subsequently been stirred for 10 minutes in an Ultra-Turrax turbodispersor at a speed of 10,000 rpm. The thusly obtained dispersion has been dehydrated by evaporation in a vacuum, fibrous mass being obtained which sodium benzoate occluded therein. With 100 milligrams of the fibrous mass, tablets have been prepared by compression, containing about 10 milligrams of sodium benzoate each.

The tabloids prepared in this manner have been subjected to in vitro release tests, using water as the extractant fluid.

The typical release trend has been as follows:

Within the second hour: 50–55%;
within the third hour: 55–65%;
within the fifth hour: 65–80%;
within the seventh hour: 75–90%;
within the ninth hour: 90–97%;
up to the tenth hour: 100%.

EXAMPLE 5

A solution of chlorfeniramine maleate (0.3% in chloroform) is admixed with an equal volume of 6% PVC solution (Ravinil S70F by ANIC) in tetrahydrofuran. The homogeneous solution thus obtained is fed through an extrusion nozzle of the kind as described in example 1 within an extrusion chamber heated at 100° C., in which nitrogen at a very high speed is flowed so as to originate an intense turbulence (Re=87,000 approx.). Microfibers are obtained, similar to those of example 1, and containing 5% of chlorfeniramine maleate.

With the so obtained microfibers, 160-milligram tablets have been prepared by compression, which thus contained 8 milligrams of chlorfeniramine maleate each, and have been subjected to in vitro release tests by using artificial gastroenteric fluids.

The release trend has been as follows: within the first hour: 40–50%; within the second hour: 50–65%; within the third hour: 60–75%; within the fourth hour: 70–90%; then, up to the seventh hour: 90–100%.

EXAMPLE 6

A 6% solution of cellulose triacetate in ethyl acetate, maintained at 40° C., is supplemented with micronized chlorfeniramine maleate, with stirring, (2-[2, dimethylaminoethyl)-benzyl]-piridine), in such an amount as to attain 8% concentration relative to the dissolved cellulose acetate.

The as obtained dispersion is maintained under vigorous stirring and is subsequently extruded by the procedure of example 1 but in such a way that the temperature prior to expansion attains 60° C., within an expansion chamber in the interior of which nitrogen is caused to flow with a turbulent motion (Re=87,000).

Microfibers are obtained which have a size similar to that of the fibers of example 1. With these, 100-milligram tablets have been prepared, which thus contained about 8 milligrams of chlorfeniramine maleate each.

The tablets have been subjected to in vitro release tests, as in example 5, the following release times having been obtained:

within the first hour: 40–45%
within the second hour: 45–60%
within the third hour: 55–65%
within the fifth hour: 65–80%
within the sixth hour: 75–85%
then, up to the twelfth hour: 95–100%.

EXAMPLE 7

A 10% solution of still partially esterified (20%) polyvinyl alcohol in water, at 85° C, is supplemented with sodium benzoate in such an amount as to attain a 10% ratio relative to polyvinyl alcohol.

The so obtained solution is fed to a nozzle, maintained at about 100° C. according to the procedure described in the Italian Patent Specification 963,102 and then passed into an expansion chamber in the interior of which methyl alcohol flows with a high turbulence (at room temperature, Re=61,000 approx.). The precipitation is thus obtained of microfibers having a size in the order of that of the fibers obtained in example 1, which have been stripped in the methanol and water mixture still impregnating them, by extraction in vacuum. Then, with the purpose of insolubilizing them in hot water, they have been subjected to a treatment with a 37% aqueous solution of formaldehyde at room temperature (acetalization of the alcoholic hydroxyls).

With the so obtained microfibers, 100-milligram tablets have been prepared (thus containing 10 milligrams of benzoate), which have been subjected to in vitro release tests, using water as the extractant fluid. The release times have been as follows:

after the first hour: 40–45%
after the second hour: 45–50%
after the fourth hour: 50–60%
after the fifth hour: 55–70%
after the sixth hour: 65–75%
after the eighth hour: 75–85%
after the ninth hour: 85–95%
up to the twelfth hour: 100%

EXAMPLE 8

A 6% solution of polystyrene in tetrahydrofuran (the used polystyrene was EDISTIR NA 168) at 40° C. was supplemented, with stirring, with micronized betametasone disodium phosphate (9-alpha-fluoro-16 beta methylprednisolone-disodium phosphate) in such an amount as to attain a concentration of 5% by weight relative to polystyrene.

The so obtained dispersion, kept stirred and brought to a temperature of 50° C. is caused to pass, following the procedure of example 1, through a nozzle having a thickness of 1 mm and a diameter of 1 mm, into an expansion chamber in which methyl alcohol is caused to flow with a turbulent motion (Re=61,000 approx.).

By so doing, the precipitation is obtained of fibers having a size similar to that of the fibers obtained in example 1.

With the so obtained microfibers there have been shaped, with a static sheet-former of the Rapid Koeten Type (Laboratory type) sheets of the approximate weight of 90 grams/sq. meter, from which strips have been taken having the size of 1 by 10 centimeters, which thus contained about 4.5 milligrams of beta-metasone phosphate each.

The strips thus obtained have been subjected to release tests using water as the extractant fluid and the following release times have been obtained:

within the first hour: 40–45%;
within the second hour: 45–55%;
within the third hour: 55–60%;
within the fourth hour: 60–70%;
within the fifth hour: 65–80%;
within the sixth hour: 75–85%;
within the seventh hour: 80–90%;
then, up to the tenth hour: 90–100%.

EXAMPLE 9

An autoclave having a heating jacket and a stirrer is charged with n-heptane and high-density polyethylene (MFI=3.5 approx.) so that the polyethylene concentration is about 10. Powdered sodium benzoate is then added in such an amount as to have a dispersion of 10% of benzoate relative to polyethylene (by stirring).

The admixture has been heated with stirring up to 210° C. (corresponding to a pressure of 12 kilograms/square centimeter) until a complete homogeneization is achieved. By a gear pump which raises the pressure to 30 kgs/sq.cm, the mixture is extruded through a nozzle having a diameter of 1 millimeter and a thickness of 1 millimeter and rapidly expanded under ambient pressure. Microfibers are obtained which have a length ranging from 1 to 10 milliliters and an average diameter of about 10 microns, occluding sodium benzoate in a ratio of about 10% relative to the polymer. With 100 milligrams of the fibrous mass there have been prepared by compression, tablets containing about 10 milligrams of sodium benzoate each. The tabloids thus obtained have been subjected to release tests in vitro, using water as the extractant fluid. The trend of release has been the following:

within the second hour: 25–30%;
within the third hour: 35–40%;
within the fifth hour: 45–50%;
within the seventh hour: 55–60%;
within the ninth hour: 65–70%;
within the thirteenth hour: 75–80%;
within the eighteenth hour: 80–85%;
within twentythird hour: 90%;
up to the thirtysecond hour: 100%.

EXAMPLE 10

Microfibers of polyethylene which contained sodium benzoate in an amount of 5% by weight (the typical release trend of line 1 of the accompanying plot, obtained by fibrillation of an admixture of sodium benzoate with high-density polyethylene in n-heptane), have been suspended in a 5% aqueous solution of sodium benzoate. They have then been stirred for 10 minutes with an Ultra Turrax turbodisperser at a speed of 10,000 rpm. The dispersion has then been dehydrated by evaporation in vacuum. With 100 grams of the as obtained fibrous mass there have been prepared by compression tablets containing as a total about 10 milligrams of sodium benzoate. The tablets thus obtained have been subjected to release tests in vitro, using water as the extractant fluid. The typical release trend (see attached plot, line 3) has been the following:

within the second hour: 40%;
within the third hour: 50%;
within the fifth hour: 65%;
within the seventh hour: 75%;
within the ninth hour: 80–85%;
within the eleventh hour: 85–90%;

within the fourteenth hour: 95%;
and up to the eighteenth hour: 100%.

What is claimed is:

1. A microfiber of irregular cross section having a length ranging from 1 to 10 millimeters with an average diameter of about 1.0 micron consisting of a synthetic, fiber-forming, thermoplastic polymeric material selected from the group consisting of low-density polyethylene, copolymers of ethylene with vinyl acetate and acrylic acid, high density polyethylene, relevant ethylene copolymers, polypropylene, polyvinyl acetate, polyvinyl alcohol, polystyrene, polyamides, polyethylene terephthalate, cellulose acetate, polyvinyl chloride, and having incorporated therewith by adsorption a material selected from the group consisting of medicaments, antiseptics, pesticides, microorganisms preservatives and sequestering agents.

2. A tabloid comprised of compressed microfibers as claimed in claim 1.

3. Sheet comprised of microfibers as claimed in claim 1.

* * * * *